US009505989B2

(12) United States Patent
Dunn et al.

(10) Patent No.: US 9,505,989 B2
(45) Date of Patent: Nov. 29, 2016

(54) PROCESSING A HYDROCARBON STREAM USING SUPERCRITICAL WATER

(75) Inventors: James A. Dunn, Calgary (CA); Mainak M. Ghosh, Calgary (CA)

(73) Assignee: ExxonMobil Upstream Research Company, Spring, TX (US)

( * ) Notice: Subject to any disclaimer, the term of this patent is extended or adjusted under 35 U.S.C. 154(b) by 95 days.

(21) Appl. No.: 14/347,561

(22) PCT Filed: Sep. 11, 2012

(86) PCT No.: PCT/US2012/054663

§ 371 (c)(1), (2), (4) Date: Mar. 26, 2014

(87) PCT Pub. No.: WO2013/070312

PCT Pub. Date: May 16, 2013

(65) Prior Publication Data

US 2014/0238905 A1 Aug. 28, 2014

(30) Foreign Application Priority Data

Nov. 8, 2011 (CA) ..... 2757962

(51) Int. Cl.

| | |
|---|---|
| ***C10G 1/00*** | (2006.01) |
| ***C10G 1/08*** | (2006.01) |
| ***C10G 31/06*** | (2006.01) |
| ***C10G 31/08*** | (2006.01) |

(Continued)

(52) U.S. Cl.

CPC ..... *C10G 31/06* (2013.01); *C10G 1/045* (2013.01); *C10G 1/047* (2013.01); *C10G 21/003* (2013.01); *C10G 31/08* (2013.01)

(58) Field of Classification Search

CPC ..... C10G 1/00; C10G 1/04; C10G 1/045; C10G 1/047; C10G 21/003; C10G 31/06; C10G 31/08

See application file for complete search history.

(56) References Cited

U.S. PATENT DOCUMENTS

| | | | | |
|---|---|---|---|---|
| 2,665,238 A | | 1/1954 | Truitt et al. | |
| 3,705,625 A | | 12/1972 | Whitten et al. | |
| 3,948,755 A | * | 4/1976 | McCollum ..... | C10G 1/00 166/303 |

(Continued)

FOREIGN PATENT DOCUMENTS

| | | |
|---|---|---|
| CA | 1246993 | 12/1988 |
| CA | 2149737 | 3/1999 |

(Continued)

OTHER PUBLICATIONS

Siskin, M., et al., Reactivity of Organic Compounds is Superheated Water: General Background, Chemical Reviews, 2001, vol. 101, No. 4, A.C.S., p. 825-835.*

(Continued)

*Primary Examiner* — Renee E Robinson
*Assistant Examiner* — Derek Mueller
(74) *Attorney, Agent, or Firm* — ExxonMobil Upstream Research Company Law Dept.

(57) ABSTRACT

A bitumen stream is upgraded by heating to near-critical or super-critical conditions in the stream. The bitumen stream may be from a water-based extraction process, an in situ bitumen recovery process, or a solvent-based bitumen extraction process. To achieve an appropriate feed stream composition, water and/or clay may be added. The clay offers a catalytic effect. To achieve an appropriate feed stream composition, water may alternatively be removed.

22 Claims, 1 Drawing Sheet

(51) Int. Cl.
*C10G 1/04* (2006.01)
*C10G 21/00* (2006.01)

(56) References Cited

U.S. PATENT DOCUMENTS

| | | | | |
|---|---|---|---|---|
| 4,057,486 | A | 11/1977 | Meadus | |
| 4,280,559 | A | 7/1981 | Best | |
| 4,344,485 | A | 8/1982 | Butler | |
| 4,572,777 | A | 2/1986 | Peck | |
| 4,648,964 | A | 3/1987 | Leto et al. | |
| 4,761,391 | A | 8/1988 | Occelli | |
| 4,818,370 | A | 4/1989 | Gregoli et al. | |
| 4,888,108 | A | 12/1989 | Farnand | |
| 5,236,577 | A | 8/1993 | Tipman et al. | |
| 5,316,664 | A | 5/1994 | Gregoli et al. | |
| 5,338,442 | A | 8/1994 | Siskin et al. | 208/435 |
| 5,853,563 | A | 12/1998 | Ripley et al. | |
| 5,899,274 | A | 5/1999 | Frauenfeld et al. | |
| 6,662,872 | B2 | 12/2003 | Gutek et al. | |
| 6,708,759 | B2 | 3/2004 | Leaute et al. | |
| 8,151,907 | B2 | 4/2012 | MacDonald | |
| 8,162,405 | B2 | 4/2012 | Burns et al. | |
| 8,172,335 | B2 | 5/2012 | Burns et al. | |
| 8,177,305 | B2 | 5/2012 | Burns et al. | |
| 8,562,078 | B2 | 10/2013 | Burns et al. | |
| 8,636,323 | B2 | 1/2014 | Prince-Wright et al. | |
| 2007/0012598 | A1 | 1/2007 | Rendall | |
| 2007/0056881 | A1 | 3/2007 | Berkowitz et al. | |
| 2007/0289898 | A1 | 12/2007 | Banerjee | |
| 2009/0139715 | A1 | 6/2009 | Choi | |
| 2009/0145805 | A1 | 6/2009 | Choi | |
| 2009/0159498 | A1 | 6/2009 | Chinn et al. | |
| 2009/0200209 | A1 | 8/2009 | Sury et al. | |
| 2010/0276983 | A1* | 11/2010 | Dunn | C10G 1/047 299/7 |
| 2011/0049010 | A1 | 3/2011 | Abdel-Halim et al. | 208/59 |
| 2011/0049016 | A1 | 3/2011 | McGrady et al. | |

FOREIGN PATENT DOCUMENTS

| | | | |
|---|---|---|---|
| CA | 2217300 | 3/1999 | |
| CA | 2316084 | 2/2002 | |
| CA | 2519736 | 3/2007 | |
| CA | 2724806 | 6/2011 | |
| EP | 1862257 | 12/2007 | |
| IN | 00090MU2009 a | 12/2010 | |
| WO | WO2009/129143 | 10/2009 | C10G 1/00 |

OTHER PUBLICATIONS

Kamimura, H., et al., Upgrading of Bitumen with Supercritical Water for a System Combined with SAGD, 1998, vol. 43, No. 3, Symposia-American Chemical Society Division of Fuel Chemistry. pp. 741-745.*

Sparks, B.D., et al. (1992) "The effect of asphaltene content on solvent selection for bitumen extraction by the SESA process", Fuel vol. 71; pp. 1349-1353.

* cited by examiner

PROCESSING A HYDROCARBON STREAM USING SUPERCRITICAL WATER

CROSS REFERENCE TO RELATED APPLICATIONS

This application is the National Stage of International Application No. PCT/US2012/054663, filed Sept. 11, 2012, which claims priority to Canadian Patent Application 2,757,962 filed Nov. 8, 2011 entitled, PROCESSING A HYDROCARBON STREAM USING SUPERCRITICAL WATER; the entirety of which is incorporated by reference herein.

FIELD

The present disclosure relates generally to processing a hydrocarbon stream, for instance a bituminous stream from the extraction of mined oil sands, or from an in situ recovery process.

BACKGROUND

Much of the world's oil is found in the form of oil sands, large deposits of which are found in Alberta, Canada. The bitumen in oil sands cannot typically be pumped from the ground in its natural form because of its high viscosity. Oil sand deposits near the surface may be recovered by open-pit mining techniques, using powered shovels to remove the oil sand and load the trucks for transport to an extraction plant. Because the bitumen itself is a highly viscous material, separating it from the sands poses certain practical difficulties. The extraction of bitumen from oil sands mined in such a manner involves the liberation and separation of bitumen from the associated sands in a form that is suitable for further processing to produce a marketable product. Among several processes for bitumen extraction, the Clark Hot Water Extraction (CHWE) process represents a well-developed commercial recovery technique. In the CHWE process, mined oil sands are mixed with hot water to create a slurry suitable for extraction. Caustic is added to adjust the slurry pH to a desired level and thereby enhance the efficiency of the separation of bitumen. Recent industry developments have shown the feasibility of operating at lower temperatures and without caustic addition in the slurrying process.

The result of most of the CHWE processes is an extract that typically comprises two parts: a hydrocarbon predominant phase (known as a bitumen froth stream), and a tailings stream made up of coarse solids, some fine solids, and water. The specific properties of the tailings will vary depending on the extraction method used, but the tailings essentially comprise spent water, reagents (e.g. surfactants), and waste ore once the recovered bitumen has been removed. A typical composition of the bitumen froth stream is about 60 wt % bitumen, 30 wt % water and 10 wt % mineral matter (solids), with some variations to account for the extraction and processing conditions. The water and mineral matter in the froth are considered as contaminants and must be either essentially eliminated or reduced to a level suitable for pipeline transportation, feed to an oil refinery or an upgrading facility.

The processes to reject the water and mineral matter contaminants are known as froth treatment processes. Due to the high viscosity of bitumen, the first step in such processes is usually the introduction of a solvent. There are two major commercial approaches to reject the froth contaminants, namely naphtha solvent-based froth treatment and paraffinic solvent-based froth treatment. Solvent addition (dilution) increases the density differential between bitumen and water and mineral matter and enables contaminants rejection, which can be carried out by any number of methods, such as centrifugation or gravity separation using multi-stage gravity settling units. The separation schemes generally result in a product effluent stream of diluted bitumen ("dilbit") and a reject or tailings stream, commonly referred to as the froth treatment tailings, comprising mineral matter, water, residual solvent, and some residual bitumen. More specifically, in a paraffinic froth treatment process the solvent dilution induces the precipitation of asphaltenes from the bitumen as an additional contaminant that results in an improvement in the efficiency of the contaminant rejection process.

An example of naphtha froth treatment (NFT) is disclosed in U.S. Pat. No. 5,236,577. Addition of naphtha and separation may yield a bitumen product containing 1 to 3 wt % water and <1.0 wt % solids. Such product composition does not meet pipeline specifications and renders the NFT product stream unsuitable for transportation through a common pipeline carrier.

Examples of paraffinic froth treatment (PFT) are described in Canadian Patents Nos. 2,149,737 and 2,217,300. The addition of sufficient amounts of paraffinic solvent results in asphaltene precipitation, formation of aggregates with the contaminants (entrained water and carryover solids in the froth), and settling. Conventional treaters which separate water and mineral matter will not remove very fine particulate ("fines") from the froth. Therefore, PFT settling vessels are sized to allow gravity settling of fines and other contaminants to provide a solids-free dry bitumen product (<300 wppm solids, <0.5% BS&W) suitable for transportation in a common carrier to refineries. Bitumen of such quality is termed "fungible" because it can be processed in conventional refinery processes, such as hydroprocessing, without dramatically fouling the refinery equipment. However, PFT is energy-intensive and expensive and results in a waste stream of asphaltenes—a potentially valuable commodity.

The CHWE process, described above, is the most commonly employed water-based extraction process. In the case of water-based extraction, water is the dominant liquid in the process and the extraction occurs by having water displace the bitumen on the surface of the solids.

Solvent-based extraction processes for the recovery of the hydrocarbons have been proposed as an alternative to water-based extraction of mined oil sands. In the case of solvent-based extraction, the solvent is the dominant liquid and the extraction of the bitumen occurs by dissolving bitumen into the solvent. However, the commercial application of a solvent-based extraction process has, for various reasons, eluded the oil sands industry. A major challenge to the application of solvent-based extraction to oil sands is the tendency of fine particles within the oil sands to hamper the separation of solids from the hydrocarbon extract. Solvent extraction with solids agglomeration is a technique that has been proposed to deal with this challenge. The original application of this technology was coined Solvent Extraction Spherical Agglomeration (SESA). A more recent description of the SESA process can be found in Sparks et al., Fuel 1992(71); pp 1349-1353.

Previously described methodologies for SESA have not been commercially adopted. In general, the SESA process involves mixing oil sands with a hydrocarbon solvent, adding a bridging liquid to the oil sands slurry, agitating the mixture in a slow and controlled manner to nucleate particles, and continuing such agitation to permit these nucleated particles to form larger multi-particle spherical agglomerates for removal. The bridging liquid is preferably water or an aqueous solution since the solids of oil sands are mostly hydrophilic and water is immiscible with hydrocarbon solvents.

The SESA process described by Meadus et al. in U.S. Pat. No. 4,057,486, involves combining solvent extraction with solids agglomeration to achieve dry tailings suitable for direct mine refill. In the process, organic material is separated from oil sands by mixing the oil sands material with an organic solvent to form a slurry, after which an aqueous bridging liquid is added in the amount of 8 to 50 wt % of the feed mixture. By using controlled agitation, solid particles from oil sands come into contact with the aqueous bridging liquid and adhere to each other to form macro-agglomerates of a mean diameter of 2 mm or greater. The formed agglomerates are more easily separated from the organic extract compared to un-agglomerated solids. This process permitted a significant decrease in water use, as compared with conventional water-based extraction processes. Furthermore, the organic extract produced has significantly lower amounts of solids entrained within compared to previously described solvent-based extraction methods.

Solvent extracted bitumen has a much lower solids and water content than that of bitumen froth produced in the water-based extraction process. However, the residual amounts of water and solids contained in solvent extracted bitumen may nevertheless render the bitumen unsuitable for marketing. Removing contaminants from solvent extracted bitumen is difficult using conventional separation methods such as gravity settling, centrifugation or filtering.

Another example of a solvent-based extraction process is described in Canadian Patent Application Serial No. 2,724,806 ("Adeyinka et al."), filed Dec. 10, 2010 and entitled "Processes and Systems for Solvent Extraction of Bitumen from Oil Sands".

Solvent deasphalting has previously been proposed for product cleaning of solvent extracted bitumen. Deasphalting technologies are described in U.S. Pat. No. 4,572,777 (Peck), issued Feb. 25, 1986 entitled: Recovery of a carbonaceous liquid with a low fines content; and U.S. Pat. No. 4,888,108 (Farnand), issued Dec. 19, 1989 entitled: Separation of Fines Solids from Petroleum Oils and the Like. The solvent deasphalting processes described in these patents do not indicate the formation of a fungible product in a deasphalting step. The processes described in these patents are limited by the type of deasphalting solvent used and the proper deasphalting solvent to bitumen ratio required for optimal solids removal. The deasphalting process described were not specific and relied more on conventional deasphalting technologies, such as those commonly used in refineries to produce heavy crude, oils to upgrade heavy bottoms streams, and/or to deasphalt oil. However, these conventional deasphalting technologies operate at high temperatures and pressures, and at a low feed rate, compared to what would be required for a large scale production facility. These deasphalting technologies are expected to be even more energy-intensive and expensive than the PFT process. Furthermore, like PFT, a portion of the potentially valuable asphaltenes are removed from the bitumen product.

Where deposits lie well below the surface, bitumen may be extracted using in situ ("in place") techniques. One example of an in situ technique is the steam-assisted gravity drainage method (SAGD). In SAGD, directional drilling is employed to place two horizontal wells in the oil sands—a lower well and an upper well positioned above it. Steam is injected into the upper well to heat the bitumen and lower its viscosity. The bitumen and condensed steam will then drain downward through the reservoir under the action of gravity and flow into the lower production well, whereby these liquids can be pumped to the surface. At the surface of the well, the condensed steam and bitumen are separated, and the bitumen is diluted with appropriate light hydrocarbons for transport to a refinery or an upgrader. An example of SAGD is described in U.S. Pat. No. 4,344,485 (Butler).

In other processes, such as in Cyclic Steam Stimulation (CSS), the same well is used both for injecting a fluid and for producing oil. In CSS, cycles of steam injection, soak, and oil production are employed. Once the production rate falls to a given level, the well is put through another cycle of injection, soak, and production. An example of CSS is described in U.S. Pat. No. 4,280,559 (Best).

Steam Flood (SF) involves injecting steam into the formation through an injection well. Steam moves through the formation, mobilizing oil as it flows toward the production well. Mobilized oil is swept to the production well by the steam drive. An example of steam flooding is described in U.S. Pat. No. 3,705,625 (Whitten).

Other thermal processes include Solvent-Assisted Steam Assisted Gravity Drainage (SA-SAGD), an example of which described in Canadian Patent No. 1,246,993 (Vogel); Vapour Extraction (VAPEX), an example of which is described in U.S. Pat. No. 5,899,274 (Frauenfeld); Liquid Addition to Steam for Enhanced Recovery (LASER), an example of which is described in U.S. Pat. No. 6,708,759 (Leaute et al.); and Combined Steam and Vapour Extraction Process (SAVEX), an example of which is described in U.S. Pat. No. 6,662,872 (Gutek), and derivatives thereof.

Presently, heavy oil and bitumen are upgraded by either thermal conversion processes which reject carbon typically as coke (delayed coking or fluid coking) or by hydroconversion/hydrocracking processes in which hydrogen is added to the heavy oil to improve properties and reject contaminants such as metals and sulfur. Although thermal conversion processes such as coking are widely practiced throughout the world and in the Athabasca region of Alberta, Canada, these processes are typically capital and operating cost intensive. Moreover, they require secondary hydrotreating to improve the quality of the coker liquids and they reject up to 25 wt % of the feed as solid coke waste which has little or no value.

SUMMARY

The present disclosure relates to a process for upgrading a bitumen stream by heating the stream to near-critical or super-critical conditions of water in the stream. The bitumen stream may be from a water-based extraction process, an in situ bitumen recovery process, or a solvent-based bitumen extraction process. To achieve an appropriate feed stream composition, water and/or clay may be added. The clay offers a catalytic effect. To achieve an appropriate feed stream composition, water may alternatively be removed.

In one aspect, there is provided a process for upgrading a bitumen production stream, the process comprising: providing a bitumen production stream; adding clay and/or adding or removing water, where required, to achieve a water content of 10 to 40 wt % and a clay content of 5 to 15 wt % to produce a feed stream; and heating the feed stream to near-critical or super-critical conditions of the water to produce an upgraded bitumen stream.

BRIEF DESCRIPTION OF THE DRAWINGS

Embodiments of the present disclosure will now be described, by way of example only, with reference to the attached Figures, wherein.

DETAILED DESCRIPTION

As used herein, the term "bitumen stream" refers to a stream derived from oil sands that requires downstream processing in order to realize valuable bitumen products or fractions. The bitumen stream is one that comprises bitumen along with undesirable components. The bitumen stream may be a stream that has already realized some initial processing but nevertheless requires further processing. The bitumen stream need not be derived directly from oil sands, but may arise from other processes. For example, a waste product from other extraction processes which comprises bitumen that would otherwise not have been recovered, may be used as the bitumen stream. Such a bitumen stream may be also derived directly from oil shale oil, bearing diatomite or oil saturated sandstones. Examples of bitumen streams are bitumen streams from a water-based extraction process, an in situ bitumen recovery process, or a solvent-based bitumen extraction process.

Generally, embodiments of the present disclosure relate to a process for upgrading a bitumen stream by heating the stream to near-critical or super-critical conditions of the water in the stream. The bitumen stream may be a bitumen stream from a water-based extraction process, from an in situ bitumen recovery process, or from a solvent-based bitumen extraction process. Certain bitumen streams will already include suitable amounts of water and clay. The clay offers a catalytic effect. Where a bitumen stream does not already have an appropriate level of clay, clay may be added. Where a bitumen stream does not already have an appropriate level of water, water may be added or removed.

Figure 1:
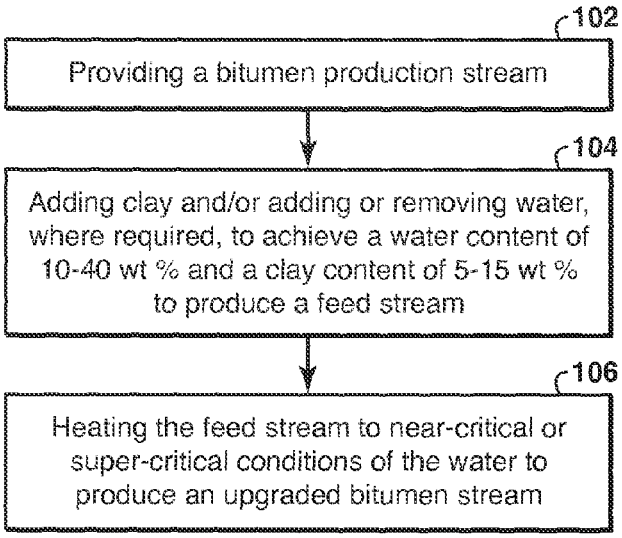
FIG. 1 is a flow chart illustrating a process according to a disclosed embodiment.

FIG. 1 illustrates one embodiment where the process for upgrading a bitumen production stream comprises providing a bitumen production stream 102; adding clay and/or adding or removing water, where required, to achieve a water content of 10 to 40 wt % and a clay content of 5 to 15 wt % to produce a feed stream 104; and heating the feed stream to near-critical or super-critical conditions of the water to produce an upgraded bitumen stream 106.

Figure 2:
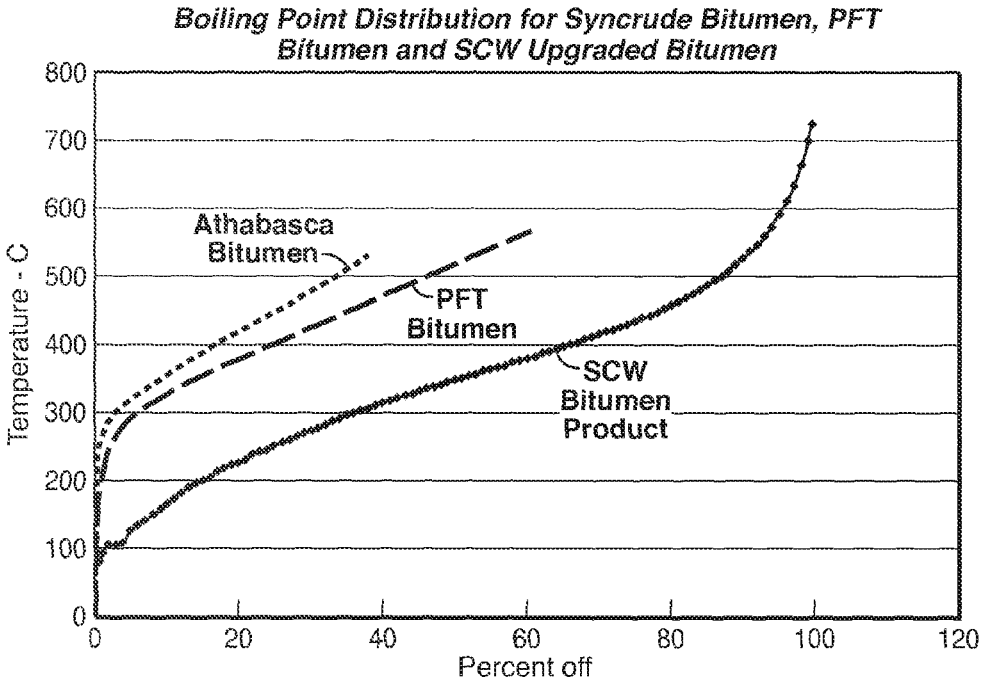
FIG. 2 is a graph illustrating boiling point distributions for three different bitumen streams.

The application of supercritical water (SCW) as a solvent, a reaction moderator, or even a possible hydrogen donor during the upgrading of bitumen has received attention. In fact, the use of water as a solvent at high temperature and pressure has been suggested to offer potential for controlling reaction pathways during bitumen upgrading. In preliminary experiments, it was demonstrated that the addition of water, under super or near-critical conditions, to bitumen in a continuous flow apparatus resulted in a significant modification of bitumen properties, namely residue conversion (as illustrated in FIG. 2 by boiling point distribution), viscosity, and Micro Carbon Residue (MCR). As illustrated in FIG. 2, the SCW bitumen product has undergone heavy end conversion leaving lighter products which boil off at lower temperatures as compared to both Athabasca bitumen and PFT.

In SCW bitumen upgrading processes, bitumen and water are heated separately to their desired temperatures and subsequently mixed, and reacted for short durations, i.e., seconds. Hydrolysis of water is theorized by one patent document where short contact time allows hydrogen radicals to react with the hydrocarbon, preventing some of the radicals from recombining to water.

Figure 3:
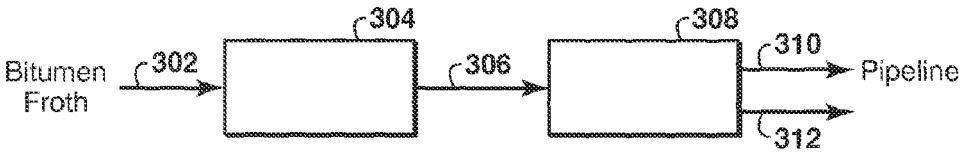
FIG. 3 is a schematic of a process according to a disclosed embodiment.

FIG. 3 illustrates one embodiment using bitumen froth as the feed stream. Bitumen froth 302 is added to a SCW upgrading vessel 304. The SCW upgrading vessel may be a thick-walled vessel, with or without internal baffles and/or a mixing device, suitably designed for the temperature and pressure conditions appropriate for near-critical or super-critical conditions of water. The bitumen froth is heated to near or above the critical point of water (374° C., 21.8 MPa) and reacted for a desired residence time, for instance 1 to 60 minutes, 1 to 10 minutes, 1 to 5 minutes, or 1 to 2 minutes. The clays present in the froth provide some catalytic activity to enhance the reaction process. The clays also act as a substance upon which some heavy metals can deposit. The heavy metals may include vanadium and nickel. Upon completion of the reaction, the upgraded bitumen and the water and solids (together 306) are sent to bitumen recovery 308 to remove residual water/solids and to recover the upgraded hydrocarbons. As a result of the SCW upgrading, the separation of the hydrocarbons from the water and solids is facilitated due to an increased specific gravity differential between the upgraded bitumen and the water and significant drop in bitumen viscosity. The upgraded bitumen 310 may be sent to a pipeline. The water and solids (together tailings 312) may be sent for tailings treatment. Heat may be recovered from the tailings.

Other potential advantages of certain embodiments may include the following. Water present in the process may serve to sequester gases (such as $H_2S$, $SO_2$, $CO_2$) produced during the process due to the inherent alkalinity of the water in the feed stream. Also, solids present in the feed stream may provide some catalytic activity toward carbon-carbon bond cleavage.

Bitumen froth may comprises about 60 wt % bitumen, 30 wt % water, and 10 wt % solids. The solids may be mostly clay. Of course, depending on the oil sands and the particular process used to obtain the froth, this composition may vary.

Certain bitumen streams may not possess the appropriate amounts of water and/or clay for this process. An appropriate water content is 10 to 40 wt %, or 20 to 30 wt % Too much water may necessitate a very large vessel, which may not be commercially desirable. Too little water will not provide an adequate solvency effect. Therefore, water may be added or removed to achieve appropriate compositions for this process. An appropriate clay content is 5 to 15 wt %. Therefore, clay may be added, if required. While clay could be removed, this may not be commercially efficient. For instance, bitumen production stream from SAGD or CSS may require dewatering and clay addition. On the other hand, a bitumen stream from a solvent-based extraction process may require the addition or both water and clay.

By using embodiments of the present process, bitumen extraction and upgrading may be integrated, with the possibility of eliminating froth treatment and generating a product that meets fungible product specifications for pipeline transportation, i.e. API, viscosity, and Basic Sediment & Water (BS&W) specifications.

In the preceding description, for purposes of explanation, numerous details are set forth in order to provide a thorough understanding of the embodiments. However, it will be apparent to one skilled in the art that these specific details are not required.

The above-described embodiments are intended to be examples only. Alterations, modifications and variations can be effected to the particular embodiments by those of skill in the art without departing from the scope, which is defined solely by the claims appended hereto.

The invention claimed is:

1. A process for upgrading a bitumen production stream, the process comprising:

providing a bitumen production stream;

adding clay and/or adding or removing water, where required, to achieve a water content of 10 to 40 wt % and a clay content of 5 to 15 wt % to produce a feed stream; and heating the feed stream to near-critical or super-critical conditions of the water to produce an upgraded bitumen stream and solids; wherein the difference in the specific gravity between the upgraded bitumen stream and the water is greater than the difference in the specific gravity between the bitumen production stream and the water, and the viscosity of the upgraded bitumen stream is lower than the viscosity of the bitumen production stream; and separating the water and solids from the bitumen production stream.

2. The process of claim 1, wherein the bitumen production stream is from a water-based extraction process, an in situ bitumen recovery process, or a solvent-based bitumen extraction process.

3. The process of claim 2, wherein the bitumen production stream is from the water-based extraction process.

4. The process of claim 3, wherein the bitumen production stream from the water-based extraction process is a bitumen froth.

5. The process of claim 4, wherein the bitumen froth comprises 50 to 75 wt % bitumen, 10 to 40 wt % water, and 5 to 15 wt % clay.

6. The process of claim 5, wherein the bitumen froth is the same composition as the feed stream and no water or clay is added or removed prior to heating.

7. The process of claim 5, wherein the bitumen froth is dewatered prior to heating to achieve a water content of 20 to 30 wt %.

8. The process of claim 2, wherein the bitumen production stream is from the in situ bitumen recovery process.

9. The process of claim 8, wherein the in situ bitumen recovery process is steam assisted gravity drainage.

10. The process of claim 8, wherein the in situ bitumen recovery process is: cyclic steam stimulation (CSS), solvent-assisted SAGD (SA-SAGD), steam and gas push (SAGP), combined steam and vapour extraction (SAVEX), expanding solvent SAGD (ES-SAGD), constant steam drainage (CSD), liquid addition to steam for enhancing recovery (LASER), cyclic solvent dominated recovery process (CSDRP), vapour extraction (VAPEX), water flooding, steam flooding, or a derivative thereof.

11. The process of claim 8, wherein the bitumen production stream is dewatered prior to heating to achieve a water content of 20 to 30 wt %.

12. The process of claim 8, wherein clay is added to the bitumen production stream prior to heating to achieve a clay content of 5 to 15 wt %.

13. The process of claim 2, wherein the bitumen production stream is from the solvent-based bitumen extraction process.

14. The process of claim 13, wherein water and clay are added to the bitumen production stream from the solvent-based bitumen extraction process to achieve a water content of 20 to 30 wt % and a clay content of 5 to 15 wt %.

15. The process of claim 1, further comprising recovering bitumen from the upgraded bitumen stream.

16. The process of claim 15, wherein the recovering bitumen from the upgraded bitumen stream comprises paraffinic froth treatment.

17. The process of claim 15, wherein the recovering bitumen from the upgraded bitumen stream comprises solvent deasphalting.

18. The process of claim 1, operated with a residence time of 1 to 10 minutes.

19. The process of claim 1, operated at a temperature above 350° C. and below 400° C.

20. The process of claim 1, operated at a pressure above 15 MPa and below 23 MPa.

21. The process of claim 1, wherein the upgraded bitumen stream meets fungible product specifications for pipeline transportation.

22. The process of claim 1, wherein the upgraded bitumen stream has a basic sediment and water content of less than 300 ppmw.

* * * * *